US009703249B2

(12) United States Patent
Uchida et al.

(10) Patent No.: US 9,703,249 B2
(45) Date of Patent: Jul. 11, 2017

(54) PRINTING APPARATUS

(71) Applicant: CANON KABUSHIKI KAISHA, Tokyo (JP)

(72) Inventors: Kota Uchida, Kawasaki (JP); Kengo Nieda, Kawasaki (JP); Ryosuke Araki, Kawasaki (JP); Shinya Asano, Tokyo (JP); Kanto Kurasawa, Tokyo (JP); Mika Masuda, Kawasaki (JP); Yusuke Nakaya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/016,926

(22) Filed: Feb. 5, 2016

(65) Prior Publication Data

US 2016/0238972 A1 Aug. 18, 2016

(30) Foreign Application Priority Data

Feb. 16, 2015 (JP) ..... 2015-027126

(51) Int. Cl.

| | |
|---|---|
| ***B41J 2/15*** | (2006.01) |
| ***G03G 15/00*** | (2006.01) |
| ***G03G 15/23*** | (2006.01) |

(52) U.S. Cl.

CPC ..... *G03G 15/6585* (2013.01); *G03G 15/234* (2013.01); *G03G 2215/00801* (2013.01); *G03G 2215/00805* (2013.01)

(58) Field of Classification Search

CPC ..... B41J 11/002; B41J 11/0015; B41J 2/01; B41J 29/377; B41J 2/04515

See application file for complete search history.

(56) References Cited

U.S. PATENT DOCUMENTS

| | | | | |
|---|---|---|---|---|
| 7,316,476 | B2 * | 1/2008 | Yokoyama | B41J 29/393 347/102 |
| 7,933,544 | B2 | 4/2011 | Nishikata et al. | |
| 8,165,515 | B2 | 4/2012 | Nishikata et al. | |
| 8,783,859 | B2 | 7/2014 | Tokisawa et al. | |
| 2013/0100222 | A1 | 4/2013 | Nieda et al. | |

FOREIGN PATENT DOCUMENTS

| | | | |
|---|---|---|---|
| JP | 2007-328023 | A | 12/2007 |

* cited by examiner

*Primary Examiner* — Lamson Nguyen

(74) *Attorney, Agent, or Firm* — Fitzpatrick, Cella, Harper & Scinto

(57) ABSTRACT

When fixing is not necessary in a printing apparatus including a fixing unit, a sheet to be conveyed is allowed to avoid the fixing unit. Specifically, a fixing unit-bypass path is provided on a conveying path corresponding to the fixing unit. Further, when a surface treatment material is not applied to a sheet from a surface treatment material applying head, that is, when fixing processing is not performed by the fixing unit, a sheet is conveyed along a fixing unit-bypass path. Since a sheet is conveyed along an bypass path when fixing processing is not performed as described above, it is possible to prevent a sheet from being affected by heat or the like while the sheet passes through the fixing unit.

10 Claims, 13 Drawing Sheets

PRINTING APPARATUS

BACKGROUND OF THE INVENTION

Field of the Invention

The present invention relates to a printing apparatus, and more specifically, to a printing apparatus including a fixing unit that can perform fixing processing on a printed sheet in a step of conveying the printed sheet.

Description of the Related Art

A printing apparatus, which includes an image forming unit and a fixing unit and can perform single-side printing and double-side printing, is disclosed in Japanese Patent Laid-Open No. 2007-328023 as a structure that performs fixing processing. Specifically, when double-side printing is performed, first, printing is performed on the surface of a sheet during the conveyance of the sheet and fixing is performed in the step of conveying the sheet. Then, the sheet is inverted, and printing is performed on the back of a sheet during the conveyance of the sheet in the same manner and fixing is performed in the step of conveying the sheet.

However, for example, even when the fixing processing of one surface of a sheet is not necessary in the case of double-side printing or fixing processing of both surfaces of the sheet is not necessary in a device disclosed in Japanese Patent Laid-Open No. 2007-328023, the sheet passes through the fixing unit in a series of steps of conveying the sheet after being printed. In this case, since the sheet passes through the fixing unit, heat is applied to, for example, an image printed on the sheet and the quality of the image may be changed.

In regard to this, it is possible to prevent the above-mentioned problem by turning off the fixing unit so that heat is not generated. However, since time is taken to turn on and off the fixing unit so that heat is generated and is not generated, throughput is reduced.

SUMMARY OF THE INVENTION

An object of the invention is to provide a printing apparatus that allows a sheet to be conveyed to avoid a fixing unit when fixing is not necessary.

In a first aspect of the present invention, there is provided a printing apparatus comprising: a conveying unit configured to convey a sheet; a printing unit configured to perform printing on the sheet conveyed by the conveying unit; a fixing unit configured to include a fixing section to perform fixing processing to the sheet that is conveyed by the conveying unit and is subjected to printing by the printing unit; a bypass path that composes a conveying path of the conveying unit and does not pass on the fixing section; and a switching unit configured to switch the conveying path of the sheet between a conveying path passing on the fixing section and the bypass path.

In a second aspect of the present invention, there is provided a printing apparatus comprising: a conveying unit configured to convey a sheet; a first printing unit configured to perform printing on a first side of the sheet conveyed by the conveying unit; a first fixing unit configured to include a fixing section to perform fixing processing to the first side of the sheet that is conveyed by the conveying unit and is subjected to printing by the printing unit; a first bypass path that composes a conveying path of the conveying unit and does not pass on the fixing section; a second printing unit configured to perform printing on a second side of the sheet conveyed by the conveying unit; a second fixing unit configured to include a fixing section to perform fixing processing to the second side of the sheet that is conveyed by the conveying unit and is subjected to printing by the printing unit; a second bypass path that composes a conveying path of the conveying unit and does not pass on the fixing section; and a switching unit configured to switch the conveying path of the sheet between a conveying path passing on the fixing section of the first fixing unit and the first bypass path or to switch the conveying path of the sheet between a conveying path passing on the fixing section of the second fixing unit and the second bypass path.

In a third aspect of the present invention, there is provided a printing apparatus comprising: a conveying unit configured to convey a sheet; a printing unit configured to perform printing on the sheet conveyed by the conveying unit; a fixing unit configured to include a fixing section to perform fixing processing to the sheet that is conveyed by the conveying unit and is subjected to printing by the printing unit; a bypass path that composes a conveying path of the conveying unit and does not pass on the fixing section; a first inverting unit configured to invert two sides of the sheet, the inverting unit being located on an upstream side of the fixing section in the conveying path of the conveying unit; a second inverting unit configured to invert two sides of the sheet, the inverting unit being located on a downstream side of the fixing section in the conveying path of the conveying unit; and a switching unit configured to switch the conveying path of the sheet between a conveying path passing on the fixing section and the bypass path and to switch the conveying path so that a surface of the sheet that is subjected to fixing processing by the fixing unit does not come into contact with the conveying unit.

According to the above-mentioned structure, a printing apparatus including a fixing unit allows a sheet to be conveyed to avoid a fixing unit when fixing is not necessary.

Further features of the present invention will become apparent from the following description of exemplary embodiments (with reference to the attached drawings).

DESCRIPTION OF THE EMBODIMENTS

Embodiments of the invention will be described in detail below with reference to the drawings.

First Embodiment

Figure 1:
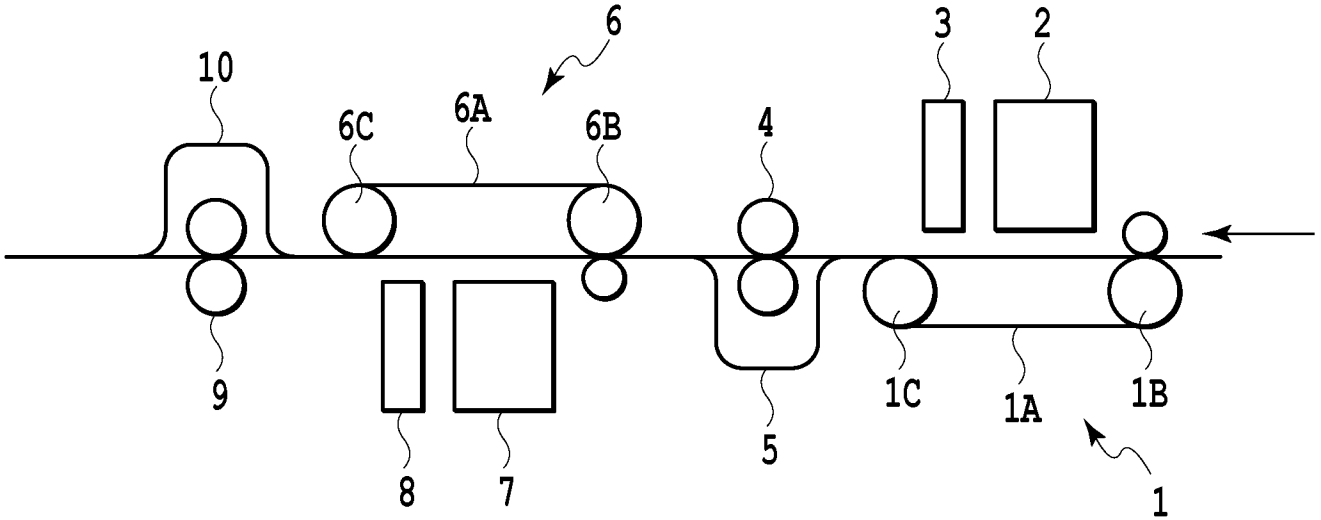
FIG. 1 is a diagram schematically illustrating the structure of an inkjet printing apparatus according to an embodiment of the present invention.

FIG. 1 is a diagram schematically illustrating the structure of an inkjet printing apparatus according to an embodiment of the present invention, and mainly illustrates the structure that is used to convey a sheet. In FIG. 1, a sheet, which is fed from a sheet feed unit (not illustrated) in a direction of an arrow, is conveyed by an adhesive conveying unit 1. The adhesive conveying unit 1 includes an adhesive conveying belt 1A that is made of rubber having adhesiveness on the surface thereof so as to have an endless shape and is stretched on an upstream belt-driving roller 1B and a downstream belt-driven roller 1C. Accordingly, the adhesive conveying unit 1 drives the belt 1A by rotating the upstream belt-driving roller 1B and conveys a sheet that is fixed to the belt by adhesion. A print head 2 performs printing an image by ejecting ink to the sheet, which is conveyed by the adhesive conveying unit 1, from the upper side in FIG. 1. In this embodiment, the print head 2 is a line type print head that includes a plurality of nozzle arrays elongated and fixed in a direction orthogonal to the conveying direction of the sheet. Meanwhile, the type of the print head is not limited thereto, and the print head may be a serial type print head that performs scanning in a direction orthogonal to the conveying direction of a sheet and performs printing of an image.

A surface treatment material applying head 3 is provided on a sheet conveying path on the downstream side of the print head 2. Accordingly, a surface treatment material can be applied to the sheet that has been subjected to printing. Meanwhile, a gloss agent, a matte material, a laminate material, and the like can be used as the surface treatment material. Moreover, a fixing unit (fixing section) 4 is provided on the sheet conveying path on the downstream side of the surface treatment material applying head 3. Accordingly, heat and pressure can be applied to the sheet to which the surface treatment material has been applied. The texture of the sheet can be stabilized by this fixing processing. Meanwhile, the fixing unit 4 has a well-known structure appropriate for the surface treatment material that is used in this embodiment.

In this embodiment, a fixing unit-bypass path 5 is provided on the conveying path corresponding to the fixing unit 4. The conveyance of the sheet to this fixing unit-bypass path is performed by a conveying path-switching mechanism (not illustrated) and the control of the conveying path-switching mechanism. In this embodiment, the sheet is conveyed along the fixing unit-bypass path 5 if a surface treatment material does not need applied to the sheet from the surface treatment material applying head 3, that is, if fixing processing does not need to be performed by the fixing unit 4. A control of the sheet conveyance allows the sheet to be conveyed along the bypass path in a case in which fixing processing does not need to be performed as described above, and thus it is possible to prevent the sheet from being affected by heat and the like while the sheet passes through the fixing unit. Further, time, which is taken until the fixing unit is turned on after the fixing unit is turned off not to generate heat and the sheet passes through the fixing unit, is not necessary.

Meanwhile, a path along which the sheet passes in the fixing unit 4 is a flat path, but the fixing unit-bypass path 5 is formed of a long path that is bent from the path passing through the fixing unit 4. Accordingly, when a surface treatment material is applied to the sheet and fixing processing is performed, the sheet can be conveyed while being flat without the application of a load. Therefore, the deterioration of the quality of an image printed on the sheet can be prevented.

A conveying path, which is used for processing such as printing on the other surface (second side) of the sheet, is provided on the conveying path on the downstream side of the adhesive conveying unit 1 that is used for the processing performed by the print head 2, the fixing unit 4, and the like. That is, the sheet, which has passed through the fixing unit 4 or the fixing unit-bypass path 5, is conveyed by an adhesive conveying unit 6. The adhesive conveying unit 6 includes a belt 6A, a driving roller 6B, and a driven roller 6C and has the same structure as the above-mentioned adhesive conveying unit 1. The adhesive conveying unit 6 is disposed so that the printed first side of the sheet is fixed to the adhesive surface of the belt 6A of the adhesive conveying unit 6. Further, a print head 7 can perform printing on the second side of the sheet by ejecting ink to the sheet, which is conveyed by the adhesive conveying unit 6, from the lower side in FIG. 1. A surface treatment material applying head 8 is provided on the downstream side of the print head 7. Accordingly, a surface treatment material can be applied to the sheet that has been subjected to printing. Then, a fixing unit 9 can perform fixing processing for stabilizing the texture of the sheet by applying heat and pressure to the sheet to which the surface treatment material has been applied.

Even on this conveying path, the sheet is controlled so as to be conveyed along a fixing unit-bypass path 10 and so as to avoid being conveyed along the fixing unit 9 when a surface treatment material does not need applied to the sheet from the surface treatment material applying head 8, that is, when fixing processing does not need to be performed. Even on this conveying path, the control of the sheet conveyance allows the sheet to be conveyed along the bypass path in a case in which fixing processing does not need to be performed, and thus it is possible to prevent the sheet from being affected by heat and the like while the sheet passes through the fixing unit. Further, time, which is taken until the fixing unit is turned on after the fixing unit is turned off not to generate heat and the sheet passes through the fixing unit, is not necessary.

Meanwhile, even in this case, as in a step of conveying the first side, a path along which the sheet passes in the fixing unit 9 is a flat path, but the fixing unit-bypass path 10 is formed of a long path that is bent from the path passing through the fixing unit 9. Accordingly, when a surface treatment material is applied to the sheet and fixing processing is performed, the sheet can be conveyed while being flat without the application of a load. Therefore, the deterioration of the quality of an image printed on the sheet can be prevented.

Figure 2:
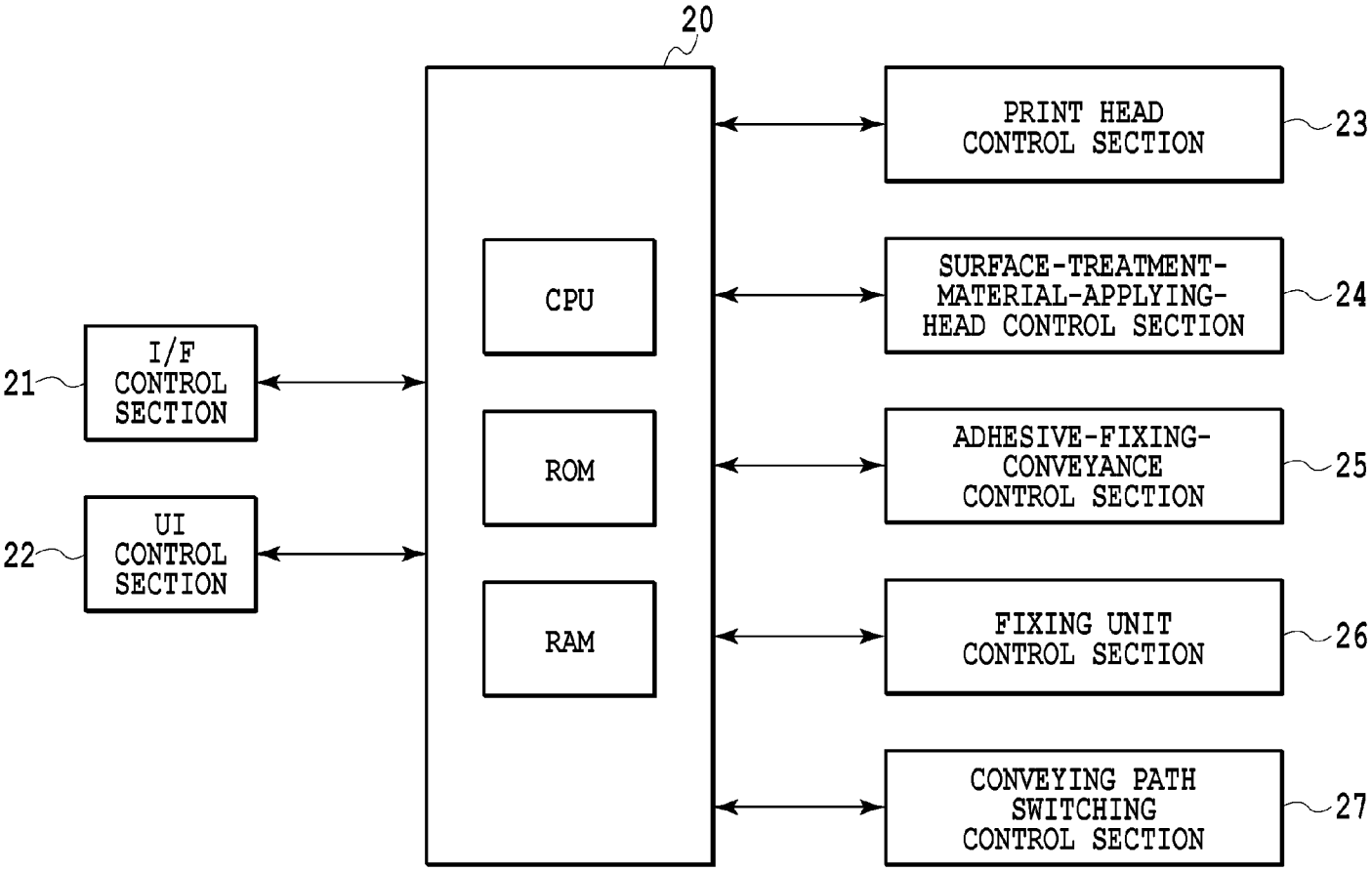
FIG. 2 is a block diagram illustrating the configuration of a control system of the inkjet printing apparatus according to the embodiment of the present invention.

FIG. 2 is a block diagram illustrating the configuration of a control system of the inkjet printing apparatus according to the embodiment of the present invention. In FIG. 2, a system controller 20 includes a CPU, a ROM, and a RAM and controls the entire printing apparatus according to this embodiment. An interface control section 21 controls the communication of image data and commands between the system controller 20 and an external device or a medium that stores image data to be printed. A user interface control section 22 displays a menu, a settings screen, and the state of the printing apparatus on a display device, and controls the reception of an operation that is input from a user.

A print head control section 23 controls the driving of the print heads 2 and 7 under instructions from the system controller 20 to allow the print heads 2 and 7 to eject ink to the sheet, which is conveyed, and performs printing of an image based on image data received through the interface control section 21. Similar to the print head control section 23, a surface-treatment-material-applying-head control section 24 controls the driving of the surface treatment material applying heads 3 and 8 under instructions from the system controller 20 to allow the surface treatment material applying heads 3 and 8 to apply the surface treatment material to the sheet that which is conveyed. An adhesive-fixing-conveyance control section 25 controls the adhesive conveying unit 1, which conveys the sheet fixed to the adhesive conveying belt by adhesion by rotating the belt-driving roller, under instructions from the system controller 20. A fixing control section 26 controls the fixing units 4 and 9, which apply heat and pressure to the sheet to which a surface treatment material has been applied by the surface treatment material applying heads 3 and 8, on the basis of instructions from the system controller 20. A conveying path switching control section 27 controls the switching of the conveying path for a sheet on the basis of instructions from the system controller 20 in processing illustrated in FIGS. 3, 5, 7, and 9 to 12. For example, in the structure illustrated in FIG. 1, the conveying path switching control section 27 switches the conveying path so that a sheet is conveyed to the fixing units 4 and 9, when a surface treatment material needs applied to the sheet, and a sheet is conveyed along the fixing unit-bypass paths 5 and 10 when a surface treatment material does not need applied to the sheet.

Figure 3:
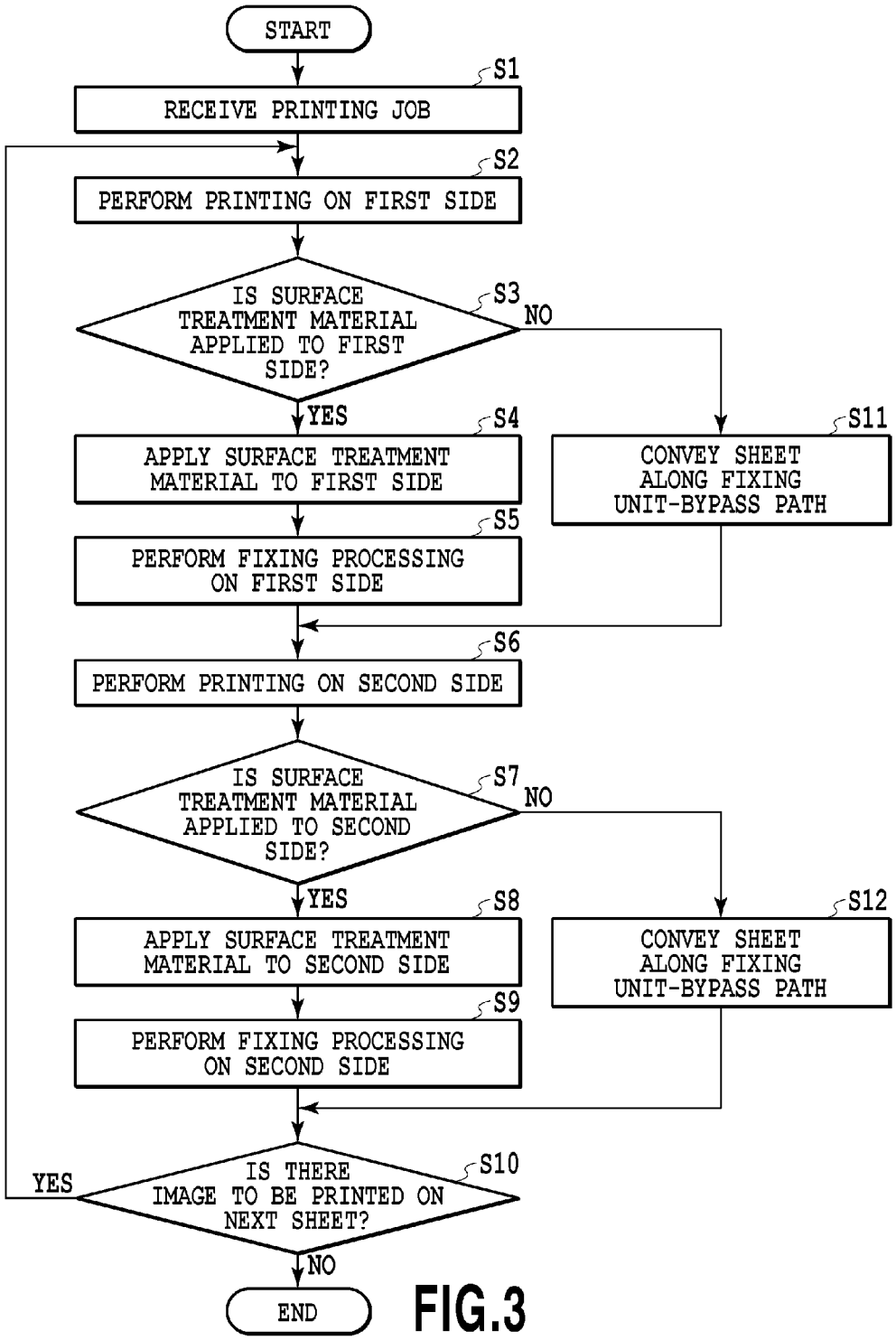
FIG. 3 is a flowchart illustrating a printing operation according to a first embodiment of the present invention.

FIG. 3 is a flowchart illustrating a printing operation according to a first embodiment of the present invention.

As illustrated in FIG. 3, when a printing job is received from an external device or the like of the inkjet printing apparatus through the interface control section 21 (Step S1), this processing is started. First, printing is performed on one surface (first side) of a sheet that is conveyed by the adhesive conveying unit 1 (Step S2). Then, it is determined whether or not a surface treatment material is applied to the first side of the sheet (Step S3). Meanwhile, whether or not a surface treatment material is applied to the printed surface of the sheet can be determined according to the material of the sheet and the type of an image to be printed. For example, gloss liquid is applied as a surface treatment material in the case of a sheet or a printed image that requires gloss as a result of printing.

If it is determined that a surface treatment material is applied, in Step S4, a surface treatment material is applied to the first side of the sheet by the surface treatment material applying head 3. Then, a conveying path is switched by the conveying path switching control section 27 so as to allow the sheet to pass through the fixing unit 4 and the fixing processing of the first side is performed (Step S5). On the other hand, when a surface treatment material is not applied, in Step S11, a conveying path for the sheet is switched by the conveying path switching control section 27 so as to allow the sheet to pass along the fixing unit-bypass path 5 and the sheet passes along the fixing unit-bypass path 5.

Next, printing is performed on the second side that is the surface of the sheet opposite to the first side. More specifically, first, in Step S6, printing is performed on the second side of the sheet of which the first side is fixed by adhesion and which is conveyed by the adhesive conveying unit 6. Next, it is determined whether or not a surface treatment material is applied to the second side of the sheet (Step S7).

When a surface treatment material is applied, in Step S8, a surface treatment material is applied to the second side of the sheet by the surface treatment material applying head 8. Then, a conveying path is switched by the conveying path switching control section 27 so as to allow the sheet to pass through the fixing unit 9 and the fixing processing of the second side is performed (Step S9). On the other hand, when a surface treatment material is not applied, in Step S12, a conveying path is switched by the conveying path switching control section 27 so as to allow the sheet to pass along the fixing unit-bypass path 10 and the sheet passes along the fixing unit-bypass path 10.

Double-side printing is performed as described above, and printing is ended if there is no image to be printed on the next sheet. If there is an image to be printed on the next sheet, the processing returns to Step S2 and the printing operation is repeated (Step S10).

In this embodiment, even though a case in which fixing processing is to be performed on both surfaces of a sheet to be conveyed, a case in which fixing processing is to be performed on only one surface of a sheet, and a case in which fixing processing does not need to be performed on both surfaces of a sheet are present together, fixing processing is performed when a surface treatment material is applied and the sheet is allowed to be conveyed along the fixing unit-bypass paths 5 and 10 when a surface treatment material is not applied. Accordingly, since the fixing units 4 and 9 do not need to be turned on and off to apply heat, printing can be performed without the reduction of throughput.

Second Embodiment

Figure 4:
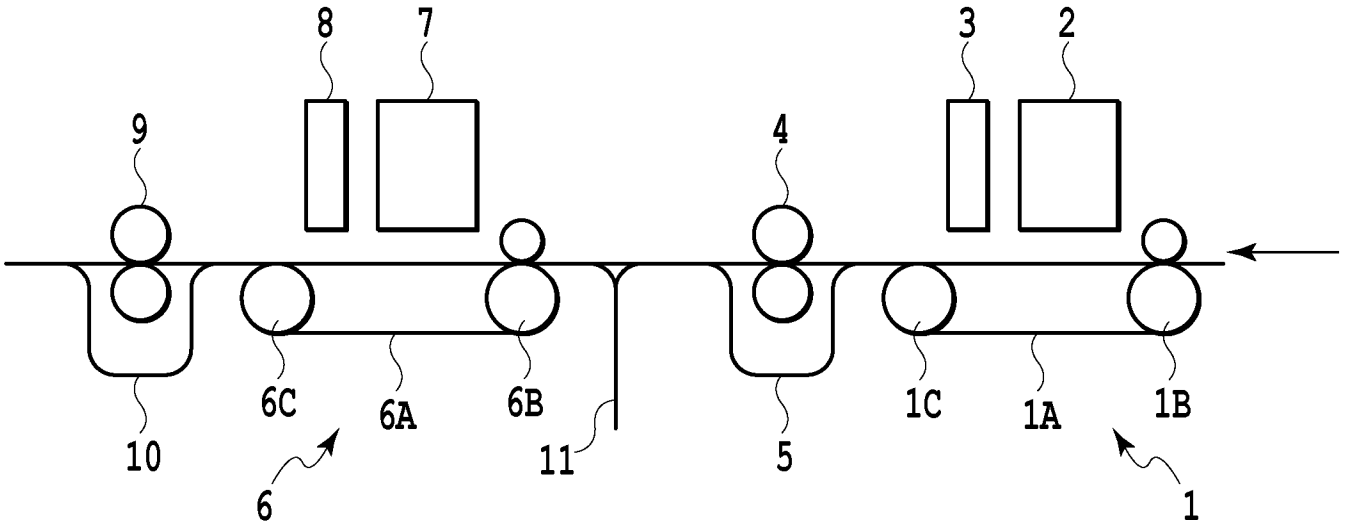
FIG. 4 is a diagram schematically illustrating the structure of an inkjet printing apparatus according to a second of the invention.

A second embodiment of the present invention relates to an embodiment in which a sheet is inverted after a step of performing printing on the first side of the sheet so that the ejection direction or the like of the print head in a step of performing printing on the second side is made to be the same as the step of performing printing on the first side. FIG. 4 is a diagram schematically illustrating the structure of an inkjet printing apparatus according to a second embodiment of the present invention, and is a similar drawing to FIG. 1 of the first embodiment. As illustrated in FIG. 4, an inverting portion 11 is provided between a conveying path of the step of performing printing on the first side of a sheet and a conveying path of the step of performing printing on the second side. Accordingly, after the step of performing printing on the first side, the sheet is inverted so that the first side of the sheet faces downward. As a result, the ink ejection direction of the print head 7 and a direction in which a surface treatment material is applied by the surface treatment material applying head 8 in the subsequent step of performing printing on the second side can be made to be the same as the ink ejection direction of the print head 2 and a direction in which a surface treatment material is applied by the surface treatment material applying head 3 in the step of performing printing on the first side.

Figure 5:
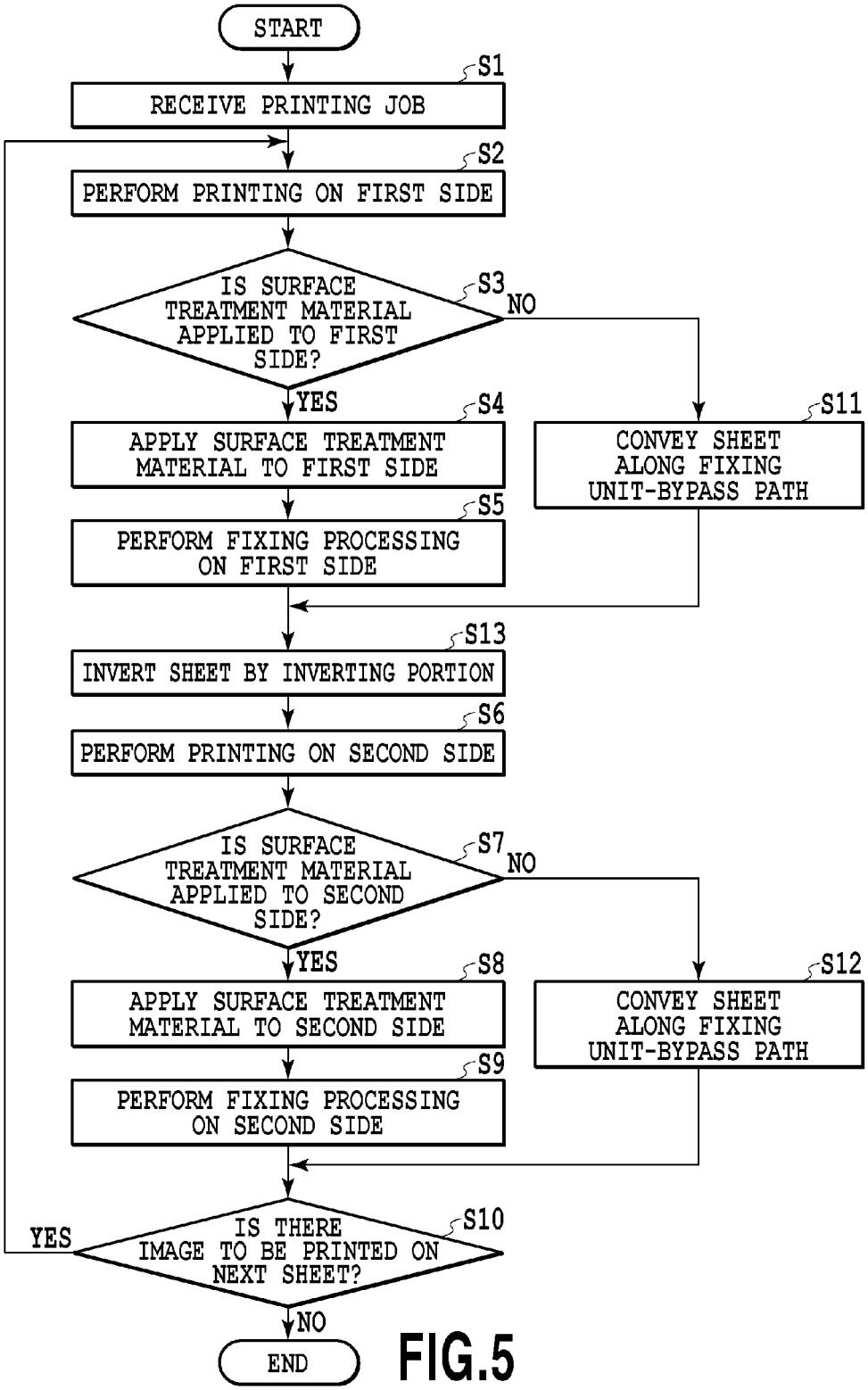
FIG. 5 is a flowchart illustrating a printing operation according to the second embodiment of the present invention.

FIG. 5 is a flowchart illustrating a printing operation according to the second embodiment of the present invention. The processing of the second embodiment is different from the processing of the first embodiment in that paper (sheet) is inverted by the inverting portion 11 between the step of performing printing on the first side and the step of performing printing on the second side (Step S13).

According to this embodiment, as in the first embodiment, fixing processing is performed when a surface treatment material is applied, and the sheet can be conveyed along the fixing unit-bypass paths if a surface treatment material is not applied. Accordingly, since the fixing units do not need to be turned on and off to apply heat, printing can be performed without the reduction of throughput. Further, the ejection of ink from the print heads 2 and 7 and the application of a surface treatment material from the surface treatment material applying heads 3 and 8 can be performed on the first and second sides of the sheet from the upper side. Accordingly, since the ejection of ink from the print head 7 and the application of a surface treatment material from the surface treatment material applying head 8 are not affected by gravity in an opposite direction, higher-quality printing can be performed.

Third Embodiment

Figure 6:
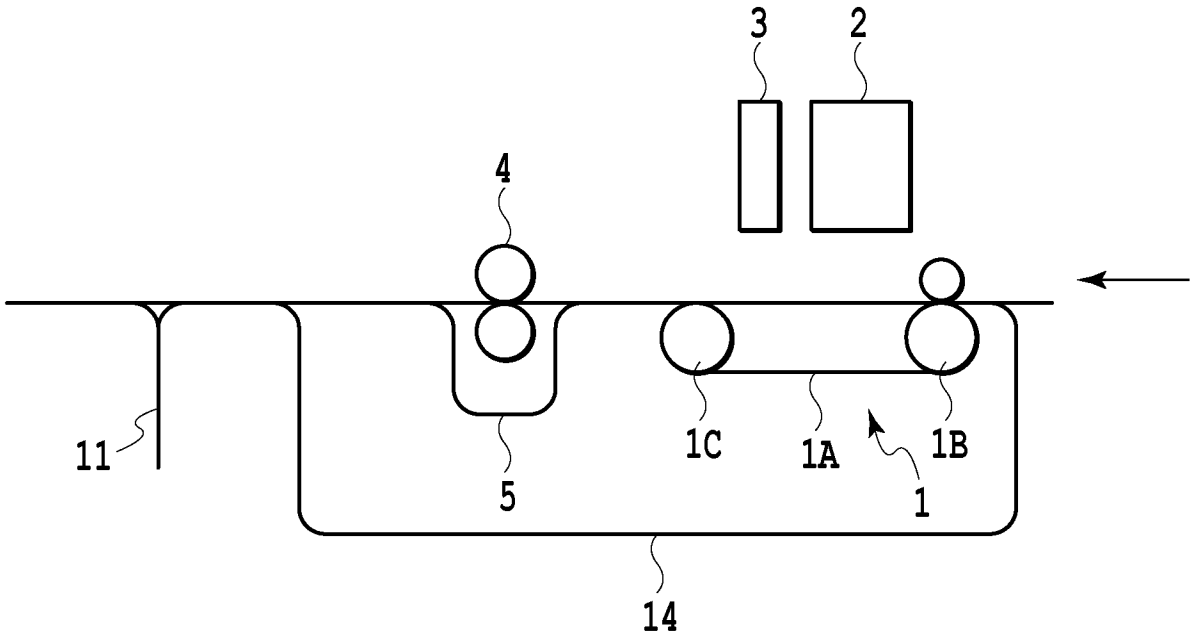
FIG. 6 is a diagram schematically illustrating the structure of an inkjet printing apparatus according to a third embodiment of the present invention.

A third embodiment of the present invention relates to an embodiment in which double-side printing can be performed by one print head 2 and one surface treatment material applying head 3. FIG. 6 is a diagram schematically illustrating the structure of an inkjet printing apparatus according to the third embodiment of the present invention. In this embodiment, only one print head 2 and only one surface treatment material applying head 3 are provided as illustrated in FIG. 6 unlike in the first and second embodiments. Further, an inverting portion 11, which is a conveying path for allowing a sheet to be inverted, is provided on a conveying path on the downstream side of the fixing unit 4, and an inverting path 14, which is a conveying path for allowing the inverted sheet to return to the conveying path using the adhesive conveying unit 1, is provided on the conveying path. More specifically, a sheet, which is conveyed by the adhesive conveying unit 1, switches back on the conveying path of the inverting portion 11 and returns to the inverting path 14. Furthermore, since the inverting path 14 is connected to the conveying path of the adhesive conveying unit 1, the sheet is inverted.

According to this structure, first, a printing operation, which applies ink by the print head 2 and applies a surface treatment material by the surface treatment material applying head 3, can be performed on the first side of the sheet conveyed by the adhesive conveying unit 1 as described in the first and second embodiments. Then, the same printing operation as described above can be performed on the second side of the inverted sheet by the conveyance of the sheet on the inverting portion 11 and the inverting path 14. That is, since the inverting portion 11 and the inverting path 14 are provided in this embodiment, double-side printing is performed by one print head 2 and one surface treatment material applying head 3.

Figure 7:
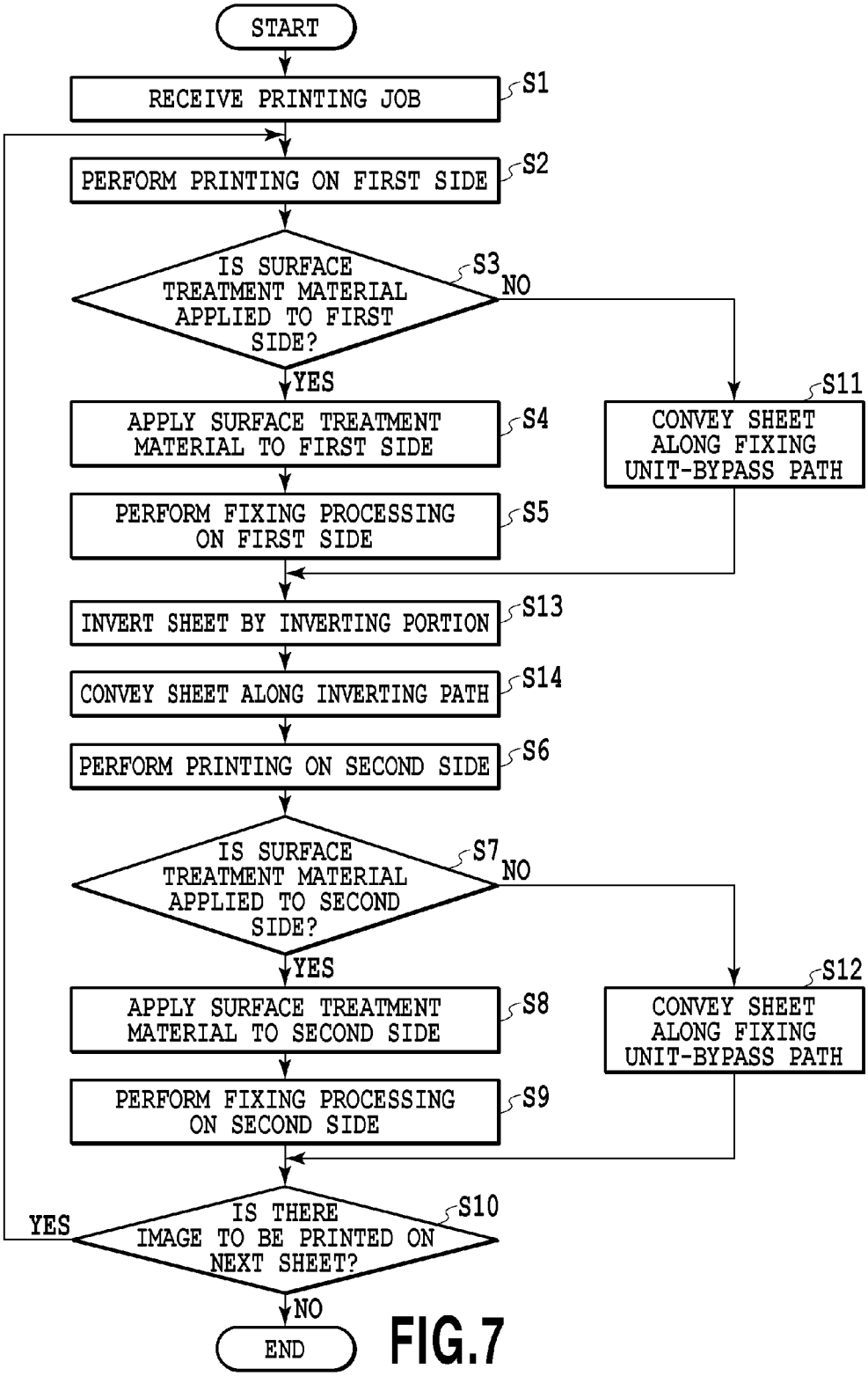
FIG. 7 is a flowchart illustrating a printing operation according to the third embodiment of the present invention.

FIG. 7 is a flowchart illustrating a printing operation according to the third embodiment of the present invention. The processing of the third embodiment is different from the processing (FIG. 3) of the first embodiment in that a step of inverting a sheet (paper) at the inverting portion 11 (Step S13) and a step of conveying the sheet along the inverting path 14 (Step S14) are added.

According to this embodiment, as in the respective embodiments, fixing processing is performed when a surface treatment material is applied, and the sheet can be conveyed along the fixing unit-bypass path when a surface treatment material is not applied. Accordingly, since the fixing unit does not need to be turned on and off to apply heat, printing can be performed without the reduction of throughput. In addition, since double-side printing can be performed by one print head and one surface treatment material applying head, it is possible to provide a printing apparatus that is inexpensive and compact.

Fourth Embodiment

A fourth embodiment of the present invention relates to an embodiment in which the surface of a sheet subjected to fixing processing does not come into contact with the belt of the adhesive conveying unit 1 unlike in the above-mentioned first to third embodiments and double-side printing can be performed.

Figure 8:
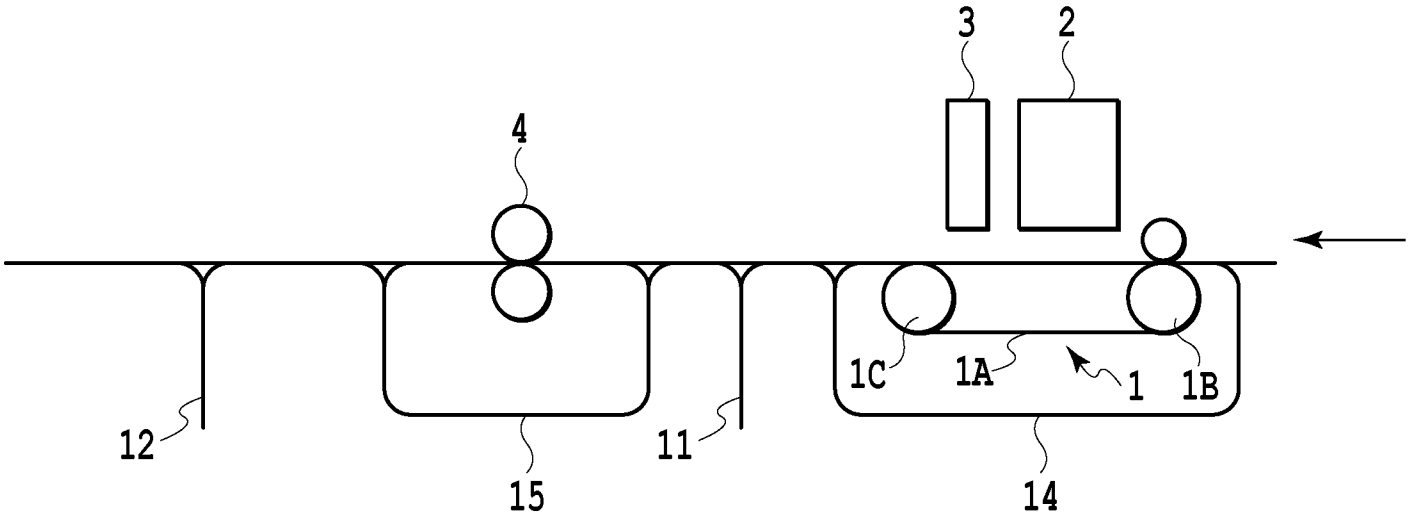
FIG. 8 is a diagram schematically illustrating the structure of an inkjet printing apparatus according to a fourth embodiment of the present invention.

FIG. 8 is a diagram schematically illustrating the structure of an inkjet printing apparatus according to a fourth embodiment of the present invention. In this embodiment, double-side printing is performed by one print head 2 and one surface treatment material applying head 3 and the inverting portion 11 and the inverting path 14 are provided as illustrated in FIG. 8 as in the third embodiment. Further, in this embodiment, an inverting portion 12 is provided and a fixing unit-bypass path 15 corresponding to the fixing unit 4 also functions as an inverting path for a sheet switching back at the inverting portion 12.

Here, when double-side printing is performed, there are following four modes for each surface of the sheet according to whether or not a surface treatment material is applied and the surface of a sheet to which a surface treatment material is applied. Meanwhile, the system controller 20 determines whether or not a surface treatment material is applied to the printed surface of a sheet, according to the material of the sheet and the type of an image to be printed, as described above, before a printing operation for the sheet is performed. Then, information about the determination is stored in a predetermined memory together with information (the first side or the second side) about the surface, which is to be printed, of a sheet. The information stored in the memory is referred to in the following processing illustrated in FIGS. 9 to 12.

(1) A case in which a surface treatment material is applied to both surfaces of a sheet (2) A case in which a surface treatment material is not applied to both surfaces of a sheet (3) A case in which a surface treatment material is applied to the first side of a sheet and is not applied to the second side (4) A case in which a surface treatment material is not applied to the first side of a sheet and is applied to the second side Control is performed in this embodiment so that the surface of a sheet subjected to fixing processing does not come into contact with the belt of the adhesive conveying unit 1 and double-side printing can be performed, in all these four modes. The respective modes will be described in detail below.

Figure 9:
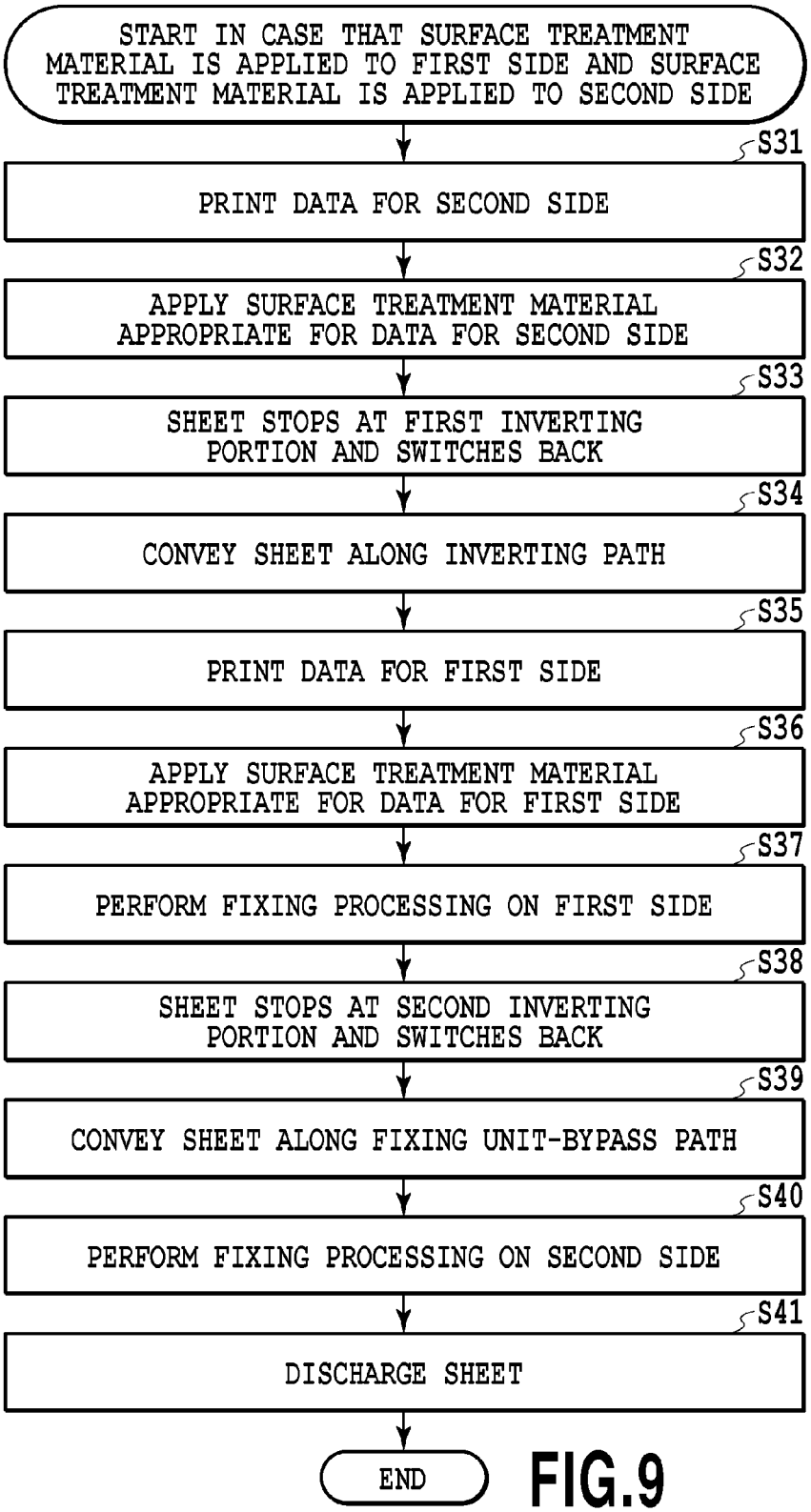
FIG. 9 is a flowchart illustrating a printing operation according to the fourth embodiment of the present invention when a surface treatment material is applied to both surfaces of a sheet.

(1) A case in which a surface treatment material is applied to both surfaces of a sheet FIG. 9 is a flowchart illustrating a printing operation according to the fourth embodiment of the present invention in a case in which a surface treatment material is applied to both surfaces of a sheet. In FIG. 9, first, data of the second side of a fed sheet are printed on the second side of the sheet (Step S31) (here, the second side means one surface of the sheet but means the surface facing upward when the sheet is finally discharged. The same applies to other modes). Then, a surface treatment material appropriate for the data of the second side is applied (Step S32). Next, the sheet is stopped at the first inverting portion 11 and switches back (Step S33), and is conveyed along the inverting path 14 (Step S34). Accordingly, the sheet is conveyed to a position immediately below the print head 2 again. In this case, the unprinted first side of the sheet faces the print head 2. Further, data of the first side of the sheet are printed (Step S35) and a surface treatment material appropriate for the data of the first side is then applied (Step S36). After that, the sheet is conveyed to the fixing unit 4 and the fixing processing of the first side is performed (Step S37). Next, the sheet is stopped at the second inverting portion 12 and switches back (Step S38), and is conveyed along the fixing unit-bypass path 15 (Step S39). Accordingly, the sheet is conveyed to the fixing unit 4 so that the second side of the sheet is an upper surface of the sheet, and fixing processing is performed (Step S40). Then, the sheet is discharged (Step S41). In this case, the sheet is in a state in which the first side of the sheet faces downward, that is, the second side faces upward.

Figure 10:
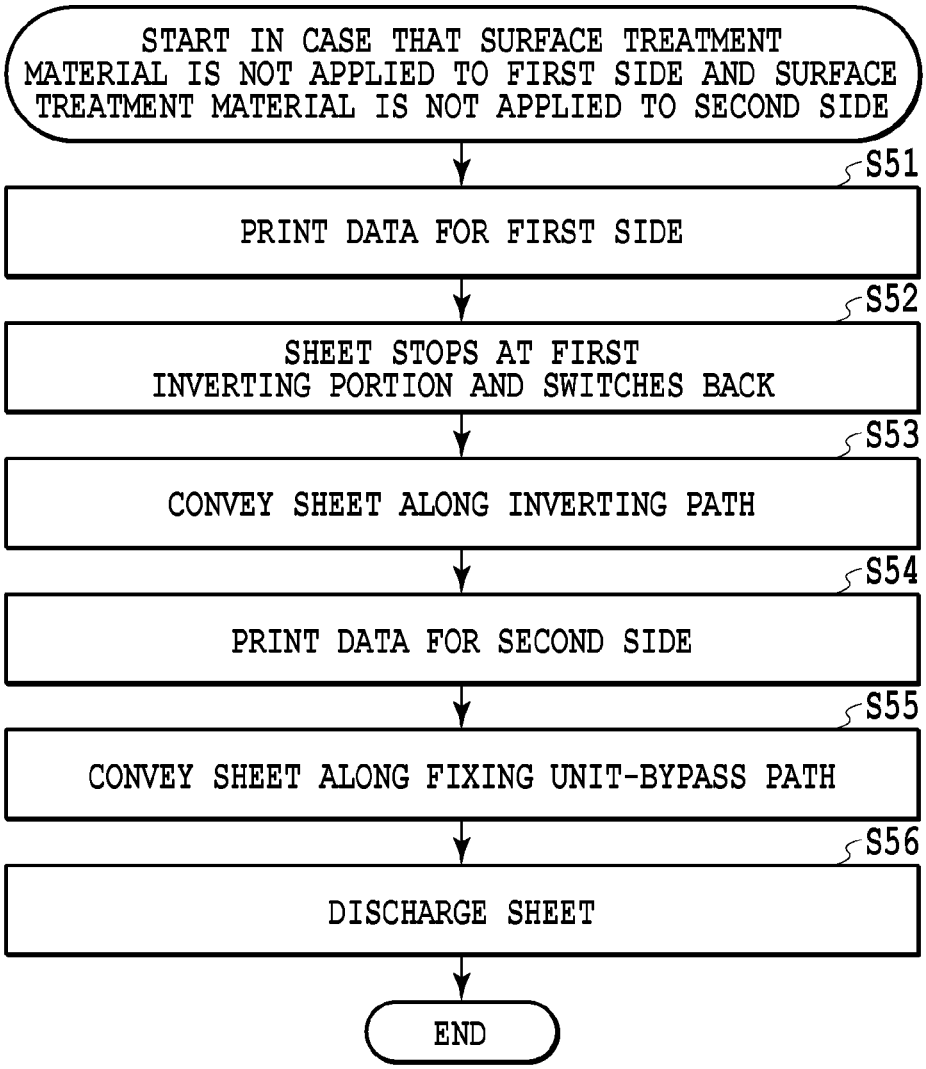
FIG. 10 is a flowchart illustrating a printing operation according to the fourth embodiment of the present invention when a surface treatment material is not applied to both surfaces of a sheet.

(2) A case in which a surface treatment material is not applied to both surfaces of a sheet FIG. 10 is a flowchart illustrating a printing operation according to the fourth embodiment of the present invention in a case in which a surface treatment material is not applied to both surface of a sheet. In FIG. 10, first, data of the first side of a fed sheet are printed on the first side of the sheet (Step S51). Next, a surface treatment material is not applied to the first side, the sheet is stopped at the first inverting portion 11 and switches back (Step S52), and the sheet is conveyed along the inverting path 14 (Step S53). Accordingly, the sheet is conveyed to a position immediately below the print head 2 again. In this case, the unprinted second side of the sheet faces the print head 2. Further, data of the second side of the sheet are printed on the second side of the sheet (Step S54). Then, a surface treatment material is not applied to the second side of the sheet, and the sheet is conveyed along the fixing unit-bypass path 15 (Step S55) and is discharged (Step S56). In this case, the second side of the sheet is an upper surface of the sheet.

Figure 11:
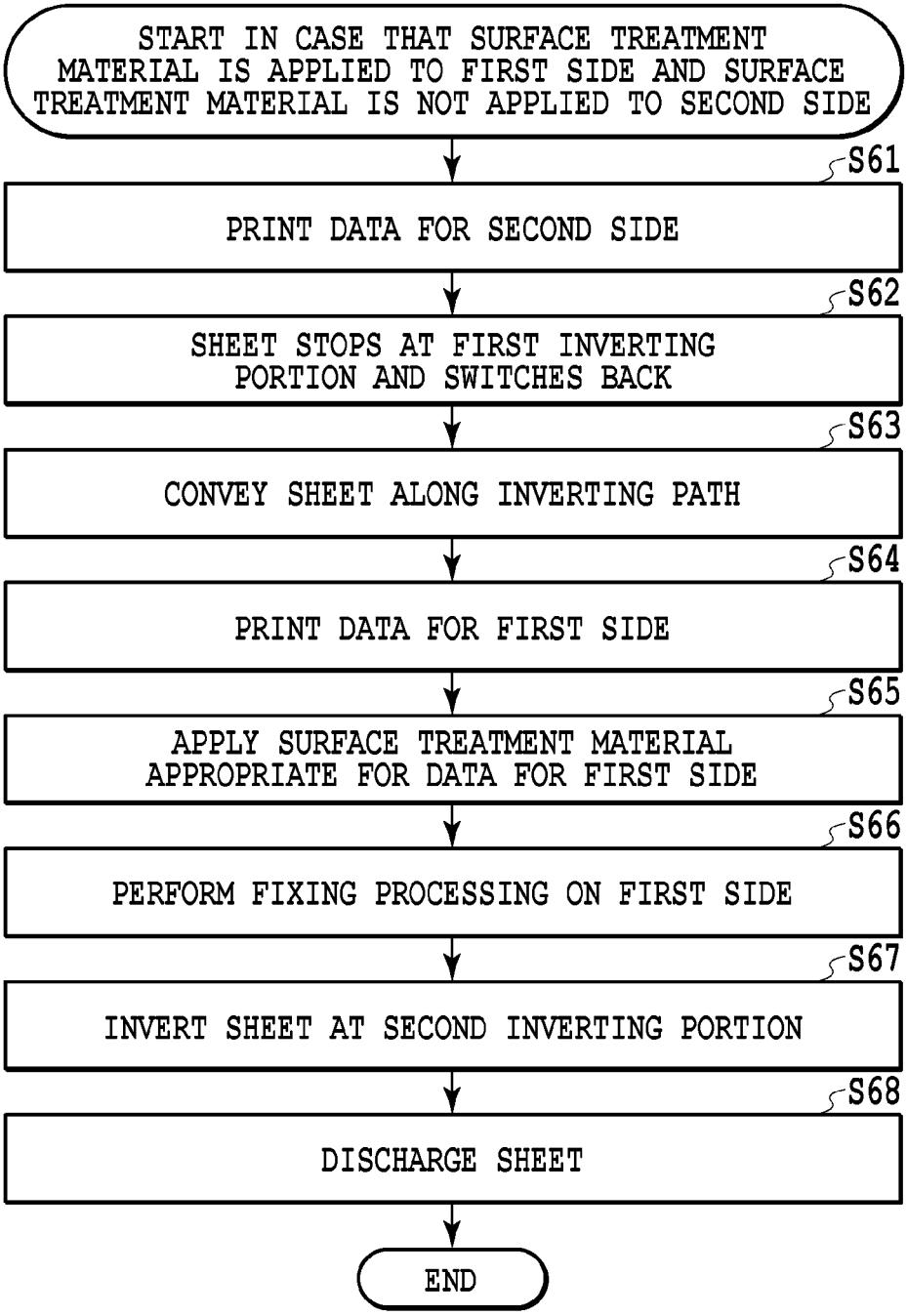
FIG. 11 is a flowchart illustrating a printing operation according to the fourth embodiment of the present invention when a surface treatment material is applied to one surface of a sheet and is not applied to the other surface thereof.

(3) A case in which a surface treatment material is applied to the first side of a sheet and is not applied to the second side FIG. 11 is a flowchart illustrating a printing operation according to the fourth embodiment of the present invention in a case in which a surface treatment material is applied to one surface of a sheet and is not applied to the other surface thereof. In FIG. 11, first, data of the second side of a fed sheet are printed on the second side of the sheet (Step S61). Next, a surface treatment material is not applied to the second side, the sheet is stopped at the first inverting portion 11 and switches back (Step S62), and the sheet is conveyed along the inverting path 14 (Step S63). Accordingly, the sheet is conveyed to a position immediately below the print head 2 again. In this case, the unprinted first side of the sheet faces the print head 2. Next, data of the first side of the sheet are printed on the first side of the sheet (Step S54) and a surface treatment material appropriate for the data of the first side of the sheet is then applied to the first side of the sheet (Step S65). After that, the sheet is conveyed to the fixing unit 4 and the fixing processing of the first side is performed (Step S66). Next, the sheet is inverted at the second inverting portion 12 (Step S67) and is discharged (Step S68). In this case, the second side of the sheet is an upper surface of the sheet.

Figure 12:
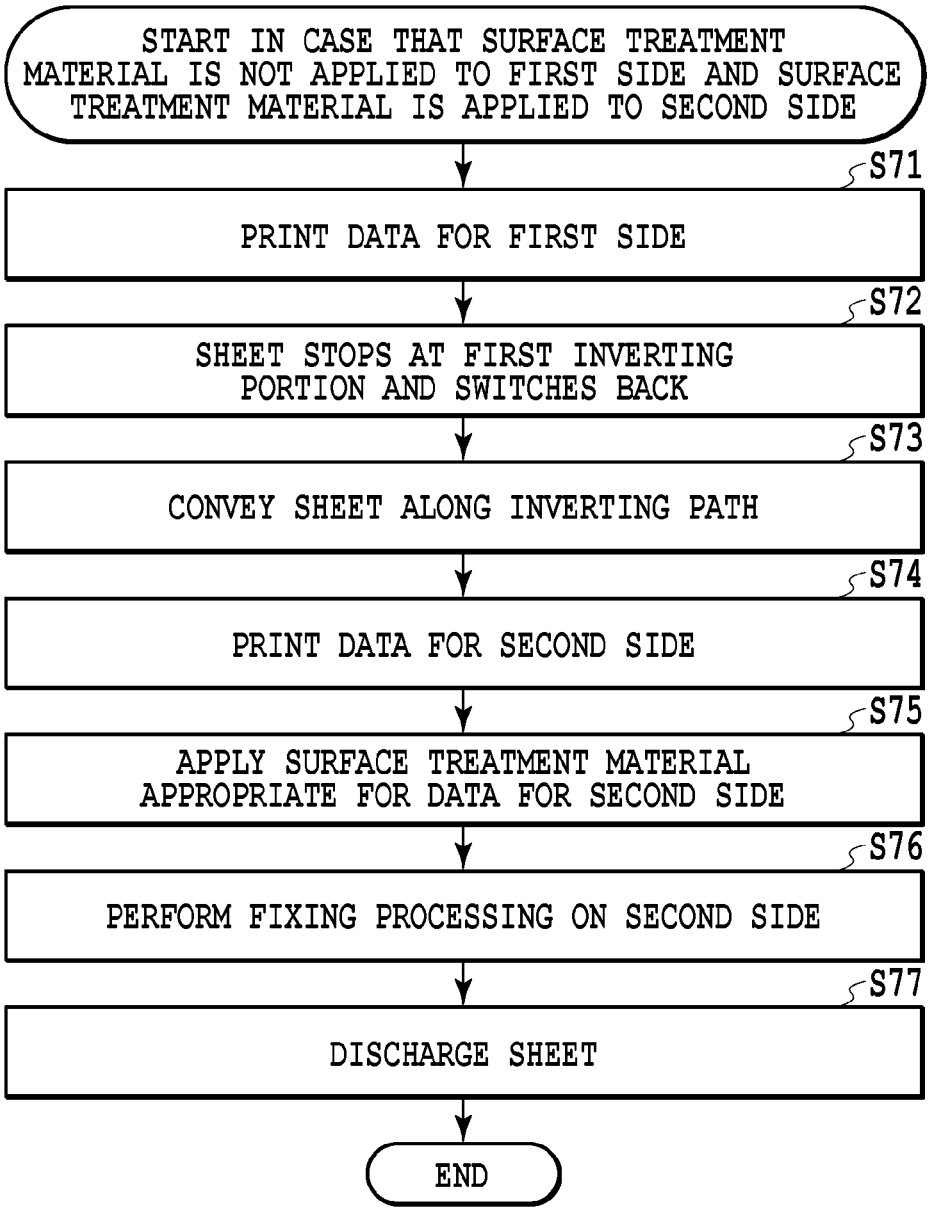
FIG. 12 is a flowchart illustrating a printing operation according to the fourth embodiment of the present invention when a surface treatment material is not applied to one surface of a sheet and is applied to the other surface thereof.

(4) A case in which a surface treatment material is not applied to the first side of a sheet and is applied to the second side FIG. 12 is a flowchart illustrating a printing operation according to the fourth embodiment of the present invention in a case in which a surface treatment material is not applied to one surface of a sheet and is applied to the other surface thereof. In FIG. 12, first, data of the first side of a fed sheet are printed on the first side of the sheet (Step S71). Next, a surface treatment material is not applied to the first side of the sheet, the sheet is stopped at the first inverting portion 11 and switches back (Step S72), and the sheet is conveyed along the inverting path 14 (Step S73). Accordingly, the sheet is conveyed to a position immediately below the print head 2 again. In this case, the unprinted second side of the sheet faces the print head 2. Next, data of the second side of the sheet are printed on the second side of the sheet (Step S74) and a surface treatment material appropriate for the data of the second side of the sheet is then applied to the second side of the sheet (Step S75). After that, the sheet is conveyed to the fixing unit 4 and the fixing processing of the second side is performed (Step S76). Then, the sheet is discharged (Step S77). In this case, the second side of the sheet is an upper surface of the sheet.

When each of the four modes of double-side printing is performed as described above, it is possible to prevent the surface of the sheet, which has been subjected to fixing processing, from coming into contact with the adhesive conveying unit 1. Accordingly, it is possible to prevent the deterioration of an image that is caused when the surface of the sheet subjected to fixing processing comes into contact with the adhesive conveying unit.

Fifth Embodiment

Figure 13:
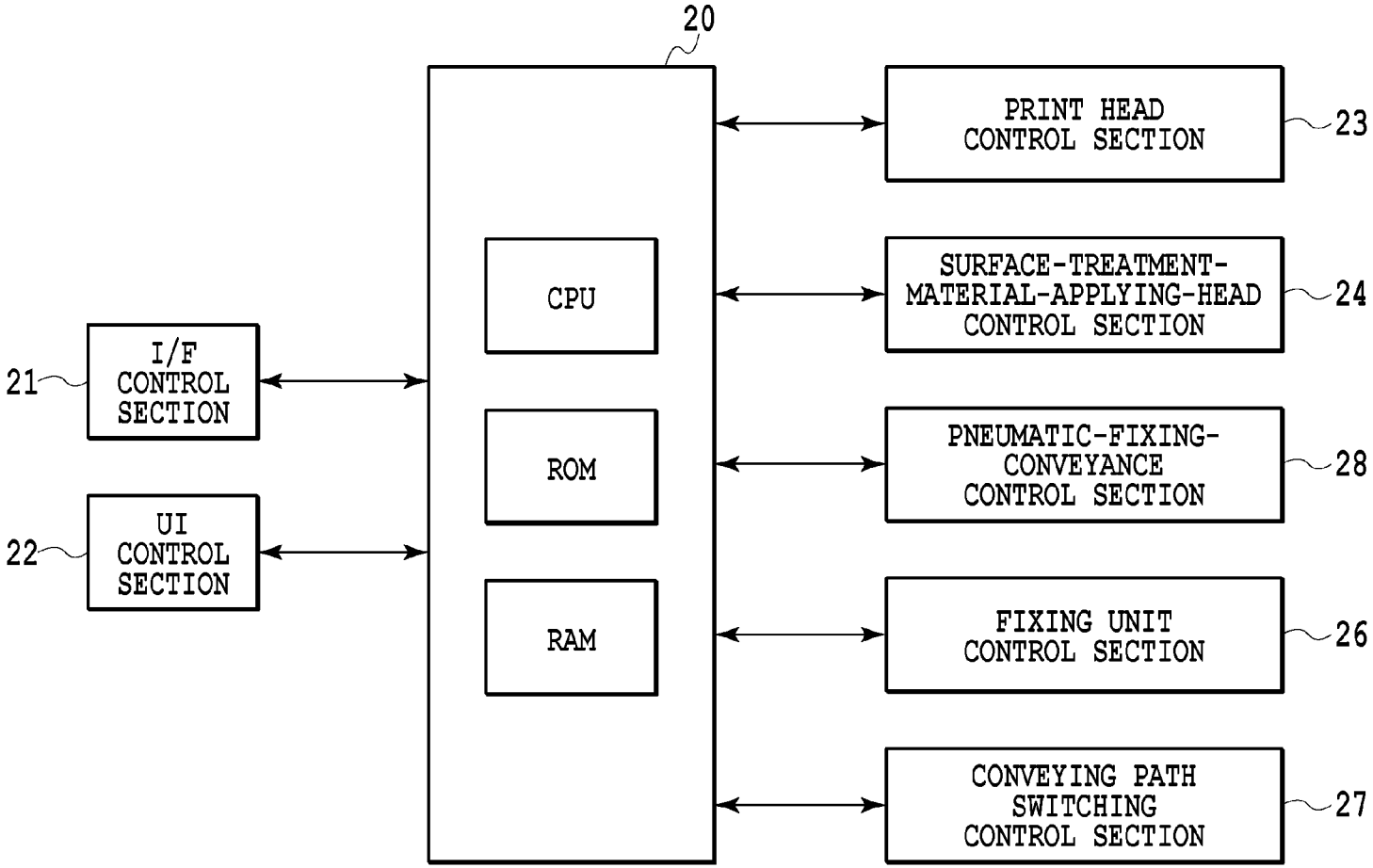
FIG. 13 is a block diagram illustrating the configuration of a control system of an inkjet printing apparatus according to a fifth embodiment of the present invention.

In the first to fourth embodiments, each of the conveying units for the sheets facing the print heads 2 and 7 has been an adhesive-fixing-conveying mechanism. However, the conveying unit may be a pneumatic-fixing-conveying mechanism that fixes a sheet by the suction of air. In this case, a control system of the inkjet printing apparatus has the control configuration illustrated in FIG. 13. That is, a pneumatic-fixing-conveyance control section 28 is provided instead of the adhesive-fixing-conveyance control section 25 illustrated in FIG. 2.

Other Embodiments

Each of the above-mentioned embodiments is an embodiment in which a sheet is conveyed so as to avoid the fixing unit in the case of double-side printing, but the application of the invention is not limited to the embodiments. A sheet may be conveyed so as to avoid a fixing unit even in the case of single-sided printing in which printing is performed on one surface of a sheet. For example, whether or not fixing processing is performed on the printed surface of a sheet can be determined according to the material of the sheet and the type of an image to be printed, as described above. For example, a surface treatment material is not applied and subsequent fixing processing is not necessary in the case of a sheet or a printed image that does not require gloss as a result of printing. In this case, when the printing of this sheet is performed, the sheet is conveyed so as to avoid the fixing unit. Accordingly, since it is possible to avoid the application of heat of the fixing unit to a printed image that is caused when the sheet passes through the fixing unit, it is possible to prevent the quality of a printed image from deteriorating.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-027126 filed Feb. 16, 2015, which is hereby incorporated by reference wherein in its entirety.

What is claimed is:

1. A printing apparatus comprising:

a conveying unit configured to convey a sheet along a main conveying path;

a printing unit configured to perform printing on the sheet conveyed by the conveying unit;

a fixing unit including a fixing section configured to perform fixing processing to the printed sheet that is conveyed on the main conveying path by the conveying unit and is subjected to printing by the printing unit;

a bypass path that comprises a conveying path branching from the main conveying path and that does not pass through the fixing section; and a switching unit configured to switch a conveying path of the printed sheet between a main conveying path passing through the fixing section and the bypass path.

2. The printing apparatus according to claim 1, further comprising an inverting unit configured to invert two sides of the sheet, the inverting unit being located on a downstream side of the fixing section in the conveying path of the conveying unit, and an inverting path for conveying the inverted sheet to a conveying path facing the printing unit.

3. The printing apparatus according to claim 1, further comprising an applying unit configured to apply a surface treatment material to a surface of the sheet that is subjected to printing by the printing unit, the applying unit being located on a downstream side of the printing unit in the conveying path of the conveying unit, wherein the switching unit switches the conveying path of the sheet that is subjected to applying of the surface treatment material by the applying unit to the conveying path that passes on the fixing section.

4. The printing apparatus according to claim 1, wherein the conveying unit includes a conveying belt that is stretched on a plurality of rollers and has adhesion for fixing the sheet for conveyance.

5. A printing apparatus comprising:

a conveying unit configured to convey a sheet;

a first printing unit configured to perform printing on a first side of the sheet conveyed by the conveying unit;

a first fixing unit configured to include a fixing section to perform fixing processing to the first side of the sheet that is conveyed by the conveying unit and is subjected to printing by the printing unit;

a first bypass path that composes a conveying path of the conveying unit and does not pass on the fixing section;

a second printing unit configured to perform printing on a second side of the sheet conveyed by the conveying unit;

a second fixing unit configured to include a fixing section to perform fixing processing to the second side of the sheet that is conveyed by the conveying unit and is subjected to printing by the printing unit;

a second bypass path that composes a conveying path of the conveying unit and does not pass on the fixing section; and a switching unit configured to switch the conveying path of the sheet between a conveying path passing on the fixing section of the first fixing unit and the first bypass path or to switch the conveying path of the sheet between a conveying path passing on the fixing section of the second fixing unit and the second bypass path.

6. The printing apparatus according to claim 5, further comprising a first applying unit configured to apply a surface treatment material to a surface of the sheet that is subjected to printing by the first printing unit, the applying unit being located on a downstream side of the first printing unit in the conveying path of the conveying unit; and a second applying unit configured to apply a surface treatment material to a surface of the sheet that is subjected to printing by the second printing unit, the applying unit being located on a downstream side of the second printing unit in the conveying path of the conveying unit, wherein the switching unit switches the conveying path of the sheet that is subjected to applying of the surface treatment material by the first applying unit to the conveying path that passes on the fixing section of the first fixing unit or switches the conveying path of the sheet that is subjected to applying of the surface treatment material by the second applying unit to the conveying path that passes on the fixing section of the second fixing unit.

7. The printing apparatus according to claim 5, further comprising an inverting unit configured to invert two sides of the sheet, the inverting unit being located between the fixing section of the first fixing unit and the fixing section of the second fixing unit.

8. The printing apparatus according to claim 5, wherein the conveying unit includes a conveying belt that is stretched on a plurality of rollers and has adhesion for fixing the sheet for conveyance.

9. A printing apparatus comprising:

a conveying unit configured to convey a sheet;

a printing unit configured to perform printing on the sheet conveyed by the conveying unit;

a fixing unit configured to include a fixing section to perform fixing processing to the sheet that is conveyed by the conveying unit and is subjected to printing by the printing unit;

a bypass path that composes a conveying path of the conveying unit and does not pass on the fixing section;

a first inverting unit configured to invert two sides of the sheet, the inverting unit being located on an upstream side of the fixing section in the conveying path of the conveying unit;

a second inverting unit configured to invert two sides of the sheet, the inverting unit being located on a downstream side of the fixing section in the conveying path of the conveying unit; and a switching unit configured to switch the conveying path of the sheet between a conveying path passing on the fixing section and the bypass path and to switch the conveying path so that a surface of the sheet that is subjected to fixing processing by the fixing unit does not come into contact with the conveying unit.

10. The printing apparatus according to claim 9, wherein the conveying unit includes a conveying belt that is stretched on a plurality of rollers and has adhesion for fixing the sheet for conveyance and the switching unit switches the conveying path so that the surface of the sheet that is subjected to the fixing processing does not come into contact with the belt.

* * * * *